US006691329B2

(12) United States Patent
Slade

(10) Patent No.: US 6,691,329 B2
(45) Date of Patent: Feb. 17, 2004

(54) LIQUID DELIVERY DEVICES

(76) Inventor: Brian Parry Slade, 20 Star Road, Ashford, Kent TN24 8BX (GB)

( * ) Notice: Subject to any disclaimer, the term of this patent is extended or adjusted under 35 U.S.C. 154(b) by 0 days.

(21) Appl. No.: 10/003,940

(22) Filed: Oct. 31, 2001

(65) Prior Publication Data

US 2002/0116751 A1 Aug. 29, 2002

(30) Foreign Application Priority Data

Nov. 2, 2000 (GB) ..... 0026832

(51) Int. Cl.[7] ..... A47K 13/00

(52) U.S. Cl. ..... 4/231; 4/223; 222/185.1; 222/187

(58) Field of Search ..... 4/223, 231, 230, 4/229, 227.1; 222/185.1, 187

(56) References Cited

U.S. PATENT DOCUMENTS

| | | | | | |
|---|---|---|---|---|---|
| 13,551 | A | * | 9/1855 | Williams et al. | 111/58 |
| 1,293,407 | A | * | 2/1919 | Goodhue | 4/223 |
| 2,075,266 | A | * | 3/1937 | Bowman | 4/224 |
| 3,349,966 | A | * | 10/1967 | Schwartzman | 222/80 |
| 3,946,448 | A | | 3/1976 | Sioufy | |
| 4,916,760 | A | * | 4/1990 | Shahar | 4/227.5 |
| 5,074,328 | A | | 12/1991 | Reinders | |
| 6,230,334 | B1 | * | 5/2001 | Camp et al. | 4/231 |
| 6,389,610 | B1 | * | 5/2002 | Hautmann et al. | 4/231 |
| 6,505,356 | B1 | * | 1/2003 | Leonard et al. | 4/231 |

FOREIGN PATENT DOCUMENTS

| | | |
|---|---|---|
| DE | 299 00 759 U1 | 4/1999 |
| EP | 0 538 957 A1 | 4/1993 |
| EP | 0 785 315 A1 | 7/1997 |
| EP | 1 046 756 A1 | 10/2000 |
| GB | 2 266 054 A | 10/1993 |
| JP | 2-6131 | 2/1990 |
| JP | 2-6132 | 2/1990 |
| WO | WO 92/20876 A1 | 11/1992 |
| WO | WO 99/66139 A1 | 12/1999 |
| WO | WO 99/66140 A1 | 12/1999 |
| WO | WO 00/42261 A1 | 7/2000 |

* cited by examiner

*Primary Examiner*—Gene Mancene
*Assistant Examiner*—Huyen Le
(74) *Attorney, Agent, or Firm*—Cesari and McKenna, LLP

(57) ABSTRACT

A liquid delivery device is particularly suited for dosing a toilet bowl with a viscous cleaning agent. Liquid from a reservoir 10 flows through a neck 52 into a cup 18 until the liquid level reaches the mouth 54 of the neck 52. The space 14 in cup 18 is open to atmosphere. Liquid is drawn from the cup 18 by a capillary 66 formed between the wall of cup 18 and an insert 60 and delivered on to the surface 72 of a textile layer 6. Flush water runs over textile layer 6 to carry the liquid into a toilet bowl.

19 Claims, 3 Drawing Sheets

LIQUID DELIVERY DEVICES

This invention relates to devices for delivering a liquid product. The invention has particular application in areas where long term and controlled release of a liquid product is required, the product being dispensed or dispersed by evaporation, such as in an air freshener or insecticide, or into a flow of other dispersing liquid such as in toilet systems, particularly systems which have an intermittent flow of the dispersing liquid. The invention is particularly concerned with delivering a liquid product such as a perfume, surfactant, bleach or disinfectant, particularly in the form of a solution, dispersion or suspension, and for delivering it to a toilet bowl under the action of water used to flush the toilet bowl.

It has been known for a long time to provide so-called toilet automatics in the form of a solid or semi-solid product, a 'rim block', to be mounted within the inner rim of a water closet bowl where the flushing water will wash over the product and so dissolve or erode it to release active constituents into the water flow. Blocks may also be placed on top of the cistern, in Japanese style systems where water from a tap flows over the block and then into the cistern, and also may be placed within the cistern below the water level, where they slowly release constituents into the water.

More recently, it has been proposed to use a liquid toilet freshening product in a similar manner, a so-called liquid rim product. For example, EP-A-0538957 describes a device that can be mounted on the inner rim of a water closet bowl to dose a liquid freshening product into the flushing water. In this device, the liquid product is dosed into the water flow from a porous substrate, a delivery plate, which is disposed in the path of the flushing water. The porous substrate is supplied with the liquid product from a container disposed above the substrate, a mouth at the bottom of the reservoir opening onto the upper surface of the substrate. Although this arrangement is simple in construction, it suffers from the drawback that the volume of liquid product that flows to the substrate between flushes is not consistent over the life time of the product, which is typically intended to be 3 to 4 weeks. Dosing seems to depend at least in part, on the head of liquid in the container, since this directly influences the rate of flow from the container onto the surface of the substrate. The container is sealed above the opening, and so a reduced pressure is created above the liquid as it flows onto the substrate. The result is an inconsistency in the dose of liquid product into the toilet bowl over time.

EP-A-0785315 describes a development of the device discussed above. The same basic principle of delivering a liquid product into a flow of water from a porous substrate is employed. However, liquid product from a container is deposited onto the upper surface of the substrate via a regulating channel. The liquid is metered into the channel through an orifice and a separate air opening to the interior of the container is provided. The sizes of the metering orifice and the air opening are strictly regulated to the viscosity of the liquid being dosed. This is described as having the effect of providing a substantially constant 'head' of the liquid above the substrate, independent of the level in the container, although the height of liquid in the container necessarily reduces over time. Although this arrangement provides a more consistent flow rate of liquid product to the absorbent substrate, inconsistent delivery to the flushing water can still result, dependent at least in part on the duration of the periods between flushes. This is thought to be due to the reliance of this device on coagulation of the liquid product to stem its flow onto the substrate, a mechanism which is very dependent on the environment in which the device is operated. It is also thought that the head of liquid bearing down on the substrate can lead to 'supersaturation' of the substrate, so it becomes over loaded with product.

WO 99/66139 and WO 99/66140 describe numerous variations of the liquid rim product, including different styles of delivery plate in place of the porous plate of EP-A-0 538 957, while WO 00/42261 describes yet another product using a grooved plate.

All of the systems still use the same basic idea of delivering liquid directly from the container's mouth onto the delivery plate.

We have noted that the porous plate systems, in particular, function even less effectively with higher viscosity liquids. It can be appreciated that the flow rate of a liquid tends to fall with increased viscosity. Thus it seems that the viscous liquid is slow to fill the voids of the porous plate in between toilet flushes and then is difficult to rinse out of the plate during the flushing action. A grooved plate has the benefit that the liquid on the plate is more exposed, but the grooves must be relatively deep to contain sufficient liquid for a dosing action, risking the retention of liquid in the grooves. Also, the number of grooves near the container mouth is necessarily limited, and so the rate of flow into the grooves is restricted.

It is one object of the present invention to provide an improved system for dosing a liquid product, particularly a viscous product.

One aspect of the present invention provides a liquid delivery device comprising a container for the liquid, a delivery surface, and means for releasing the liquid onto the delivery surface, wherein the delivery surface comprises a layer of textile material.

It has been found that a textile surface can provide for a faster and better spread of a viscous liquid over a dosing area, as compared to a porous substrate or grooved plate of the prior art. Without wishing to be bound by theory, it is believed that the relatively fine surface structure of the textile surface may contribute.

The better spread of the viscous liquid counters its greater resistance to dissolution and dispersal in flushing water, as compared to the more easily dispersed low viscosity liquids.

Very preferably the viscous liquid is not absorbed, or not absorbed substantially into the fabric and so it is washed off more readily by flushing water in a toilet bowl, or evaporates more readily to atmosphere to provide improved fragrance.

Textile material is a material or fabric made from fibres, yams or filaments (herein referred to generally as fibres). The material may be non-woven, in which fibres are bonded, fused or interlocked, but a material made by interweaving, intertwining or interlooping (referred to generally herein as weaving or knitting) is preferred.

The material is preferably of quite dense structure when seen in plan, so as to present a substantially continuous surface, with few if any voids between adjacent fibres. By virtue of the weaving or knitting process, the fabric will have a textured or three dimensional surface.

Preferably the surface is compacted, that is with few fibres or fibrous elements projecting from the surface, and the surface texture having a low profile or height.

A particularly preferred textile material is a polyester knitted fabric such as used for a closely knit pattern in net curtain material. A particular example is a knitted polyester fibre.

The liquid from the container can be delivered directly onto the upper surface of the fabric from above, for example using devices of the type seen in EP-A-538 957, WO 99/66139 and WO 00/42261. However it is particularly preferred to deliver the liquid from a cup located below the fabric. A capillary system delivers the liquid on to the fabric surface. The capillary may be a series of grooves or channels, a porous member, or a wick of cellulose, polyester or the like as used in air fresheners, for example. A system for delivering liquid onto the upper surface of a delivery plate is described in my International Patent Application filed concurrently herewith the contents of which are incorporated herein by reference. Such a system is suitable for use with the textile surface of the present invention.

The invention will be described in more detail, by way of example, with reference to the accompanying drawings, in which.

Figure 1:
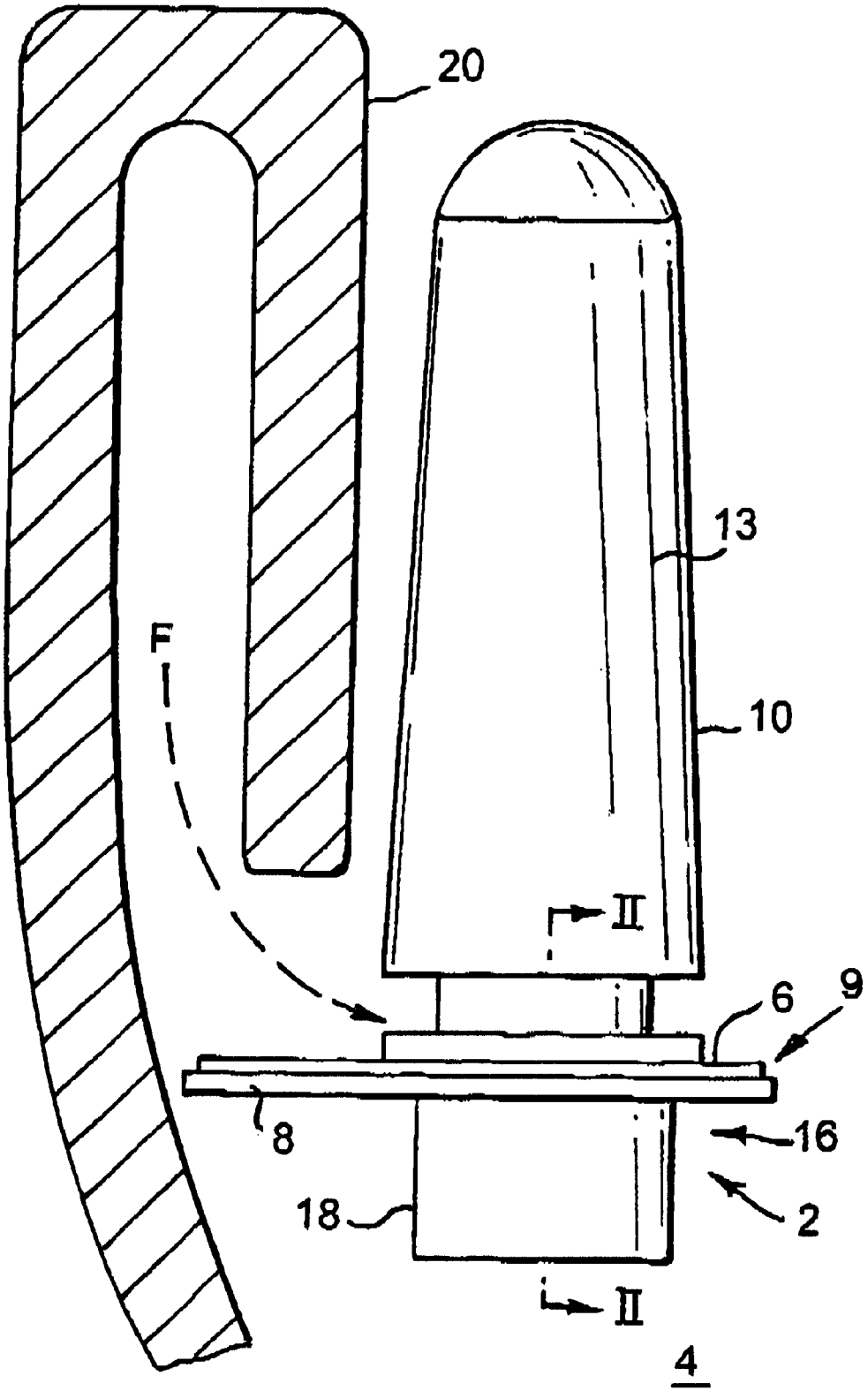
FIG. 1 is a schematic side elevation of a device forming an embodiment of the invention, including a liquid container and showing its mounting position relative to the rim of a water closet bowl.

The device 2 of FIG. 1 is adapted for delivering a liquid product 13, such as a cleansing and/or deodorising product into the bowl 4 of a water closet, in conjunction with the flow of water F generated when the water closet is flushed. The device comprises a textile material layer 6 which is supported on a generally horizontal platform 8 to form a delivery plate 9 in the path of the flushing water F, the textile material layer 6 providing a delivery surface 72. A container 10, mounted on the device 2 above the delivery plate 9, serves as a reservoir for the liquid product 13 which is fed under the influence of gravity to a cup 18 disposed below the delivery plate 9. The liquid product 13 is transported upwardly from the cup 18 to dose the textile layer 6. Although not shown in the Figures, the device also includes a strap by which it can be suspended from the rim 20 of the water closet bowl (much in the same way as a conventional 'rim block'), and may be surrounded by a cage-like structure to offer some protection to the substrate 6. A particular textile which has been used is knitted on a Karl Meyer Raschel Jacquard=RMJG 5 FNE Machine, Warp (Pillar) 150/36 Semi Dull Polyester (Flat) Front Bar (Top Creel) 1/167 Textured Polyester.

Looking at the device in more detail, it has a base 16 of polypropylene, which includes the circular cup 18 and a flat, rectangular platform 8, which surrounds and extends outwardly from the mouth of the cup 18. The cup 18 is set centrally in the platform 8 in its lateral dimension, but is offset towards the front of the platform 8 in order that, as seen in FIG. 1, a substantial part of the rear of the platform 8 can protrude below the rim 20 of the water closet bowl 4 so that a greater volume of flushing water flows over the textile layer 6.

Any of a number of different textile materials may be used, the particular form of material being selected based on the application to which it will be put, to provide the surface for liquid 13 to disperse away from the region of the cup 18, whilst the textile preferably does not retain too great a volume of the flowing liquid into which liquid 13 is dosed. A material with hydrophobic properties may be preferred.

The container 10 is rigid, or at least semi-rigid, so that it does not collapse as it empties and typically is blow moulded of polyethylene. It is separable from the unit 16 in order that it can be easily refilled, or more typically replaced; that is to say 'refill' containers can be provided much in the same way as replacement 'rim blocks' are provided for the 'rim blocks' referred to in the introduction. The overall shape of the container 10 is largely immaterial, but a slim configuration is preferred so as not to project too far across the water closet bowl 4. If desired, the walls of the container 10 can be transparent, so that the amount of liquid product 13 remaining can be easily ascertained. The liquid product may be coloured to make this determination of level even easier.

Figure 2:
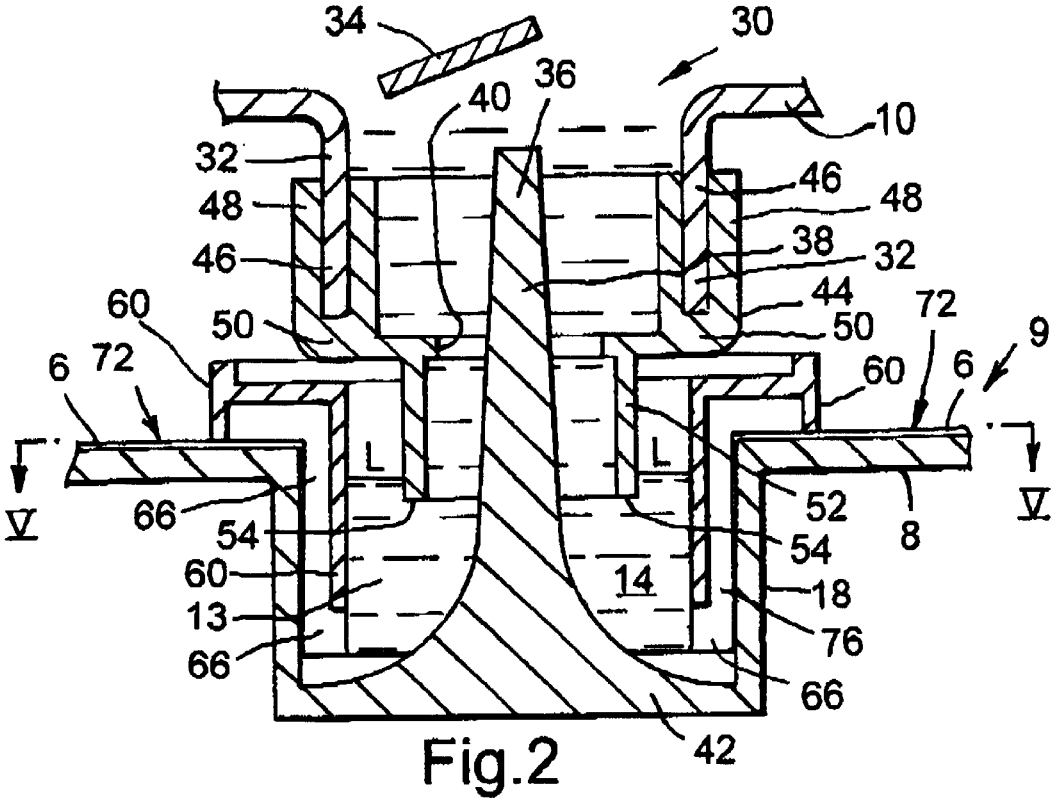
FIG. 2 is a cross-section through line II—II of FIG. 1.

As illustrated in FIG. 2, the container 10 has an opening 30 in its bottom wall with a downwardly depending neck 32. The opening 30 of the container is, initially, closed by a seal 34 secured across the neck 32. To mount the container 10 on the delivery device 2, the neck 32 of the container 10 is pushed down onto the upper end 36 of a prong 38 which breaks the seal 34 away from its mounting 40.

The device can be used for delivery of a variety of liquid products into a liquid flow. Typically, for the exemplary application described—cleansing and deodorising a water closet bowl—the liquid product 13 will include both surfactant and perfume components. The device is also suitable for delivering air freshener or insecticide. The Theological behaviour of the material, in particular its viscosity, can be selected with regard to the physical properties of the textile material and vice versa, to ensure that the product can spread rapidly over the material layer to provide a sufficient dose of liquid which is washed into the toilet bowl by the flush water. This invention is particularly suitable for relatively viscous liquids, preferably greater than about 1500 cP (centipoise), more preferably greater than 2500 cP, and particularly greater than about 3000 cP, measured in a Brookfield LV viscosimeter at spindle No. 2 speed 6 at 20° C.

When the water closet is flushed, water flows down onto and over the textile material layer 6 supported on the platform 8. The liquid product dose is flushed from the layer 6 by this flow of water and delivered to the water closet bowl 4. Once the flow of flushing water stops, and excess water has drained away, the surface of layer 6 is "refilled" automatically with the liquid product 13 as will be described in more detail below.

A small amount of water tends to be retained on the surface of the substrate. As this water evaporates it has been found to release the perfume component of the liquid product, providing a deodorising effect between flushes.

Referring to FIG. 2, the cup 18 is integrally formed with platform 8. The prong 38 extends up from the bottom wall 42 of the cup 18 to displace the seal 34 of a closure 44 of the container 10. Closure 44 has inner and outer walls 46, 48 which are joined by a web 50 and embrace the neck 32 of the container 10 in a liquid tight seal. The closure 44 has a connecting portion 52 which extends away from the container 10 to define a mouth 54. Seal 34 is held at lip 40 on the inner rim of web 50, prior to being displaced by prong 38.

To form a capillary system for transporting liquid 13 from the inner volume 14 of cup 18, a grooved insert 60 is provided.

Figure 3:
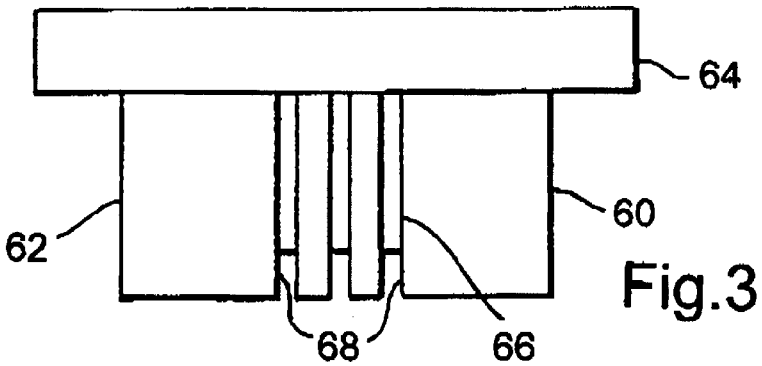
FIG. 3 is a side view of an insert to be placed in a cup of the device of FIG. 1.

FIG. 3 shows a side view of insert 60 which comprises a circular cross-section cylinder wall 62 with a radially extending collar 64 at its upper end. Cylinder 62 is a snug fit in the cup 18.

Figure 4:
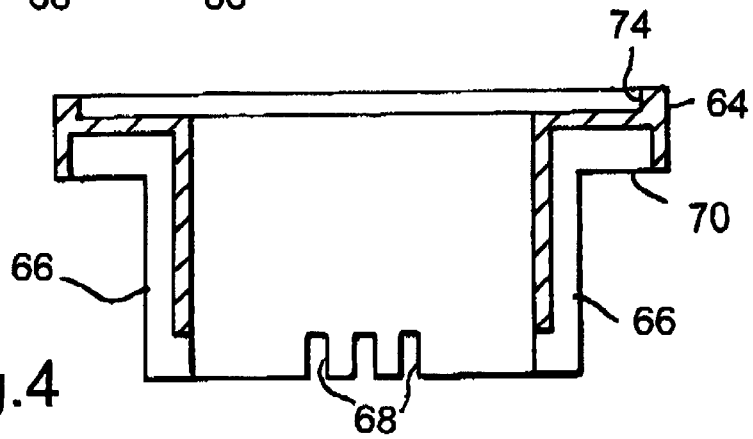
FIG. 4 is a cross-section on a diameter of the insert of FIG. 3.

Smooth walled capillary grooves 66 are formed in the outer surface of cylinder 60 around the complete periphery (only three grooves are shown in FIGS. 3 and 4). At the lower end of each capillary 66, notches 68 extend completely through the cylinder wall 62.

FIG. 4 is a cross-section through the insert 60 on a diameter. It can be seen that capillaries 66 extend up into the collar 64 and across the underside 70. Thus, referring back to FIG. 2, the capillaries form a passage for liquid from volume 14, up between insert 60 and the wall of cup 18, to the upper surface 72 of the textile layer 6.

The capillaries could be formed in the wall of the cup or by cooperation of the cup wall and insert wall, to deliver liquid up to the level of the fabric and the liquid may then permeate upwards or sideways into the fabric. However, it is particularly preferred to provide a capillary system for delivering liquid onto the upper surface of the textile layer 6.

Figure 5:
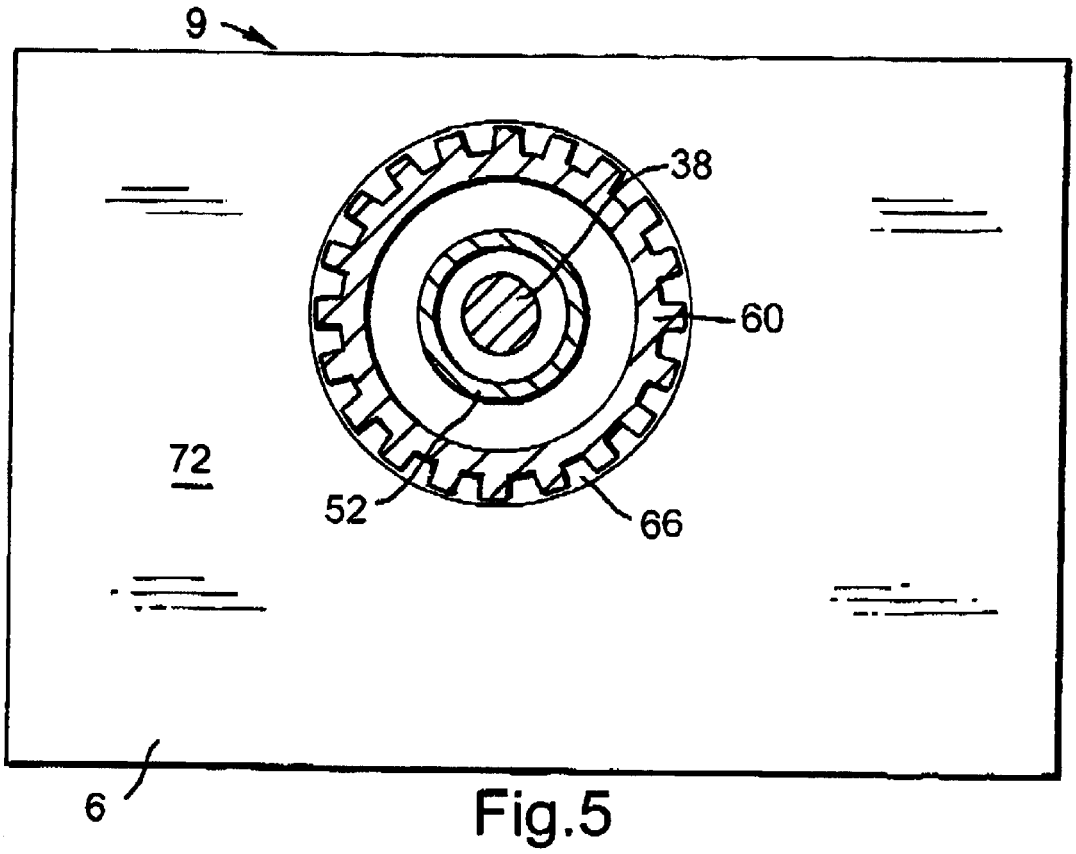
FIG. 5 is a cross-section on line V—V of FIG. 2.

The upper surface of the collar 64 is recessed at 74 to provide an air gap around the closure 44. It will be appreciated that a support or guide will also be provided to support container 10 in position and this may be in the form of a surrounding cage structure as known in the art. FIG. 5 shows the upper surface 72 of the textile layer 6, extending away from the cup 18 and insert 60.

As described above, container 10 is inserted over the prong 38 to displace seal 34. Liquid 13 flows into volume 14, through notches 68 and up capillaries 66. The liquid in volume 14 reaches a level L just above mouth 54, when it is balanced by the partial vacuum created in container 10, volume 14 being open to the atmosphere. Liquid rises in capillaries 66 under hydrostatic pressure to level L and then the liquid in capillaries 66 will rise further, because of the capillary action, until it moves onto the surface 72 where it spreads away from the collar 64.

It can be seen that the flow of liquid 13 on to textile layer 6 is substantially independent of the amount of liquid remaining in container 10, and is governed by the liquid level L in cup 18 and the capillary action generated by capillaries 66. As level L falls below mouth 54, air can enter container 10 to allow more liquid to fall into volume 14.

The cross-section of the capillaries 66 can be modified to suit the viscosity of the liquid 13, a more viscous liquid generally requiring a larger capillary size as the rate of flow of the liquid through a given capillary is slower for a more viscous liquid. Also, the number of capillaries can be adjusted. It is desirable to ensure sufficient liquid flow to replenish the dosage delivered to textile layer surface 72 within about 30 seconds to 10 minutes.

An experiment was conducted to illustrate the effect of viscosity of the liquid on the vertical flow of liquid in a capillary.

Two glass plates were spaced apart from an amount "d" and dipped into a typical formulation shown in Table 1, adjusted for viscosity. The height reached by the liquid after 10 minutes was noted, and the results are shown in Table 2.

TABLE 1

| Formulation Reference | Formulation Details Wt. % | | Viscosity in cP Spindle 2 Speed 6 |
|---|---|---|---|
| LR126 "d" | Water (mains) | balance | 3400 |
| | Natrosol Cellulose Thickener | 0.4 | |
| | Preservative | 0.1 | |
| | Anionic Surfactant | 26.5 | |
| | Nonionic Surfactant | 10.0 | |
| | Solvents | 10% | |
| | Antioxidant | 0.004 | |
| | Perfume | 10.0 | |

TABLE 1-continued

| Formulation Reference | Formulation Details Wt. % | | Viscosity in cP Spindle 2 Speed 6 |
|---|---|---|---|
| | Dye | 0.0024 | |
| RLR067 | As LR126 "d" but; Natrosol | 0.00 | 150 |
| RLR069 | As LR126 "d" but; Natrosol | 0.10 | 350 |
| RLR070 | As LR126 "d" but; Natrosol | 0.20 | 850 |
| RLR071 | As LR126 "d" but; Natrosol | 0.45 | 5100 |
| RLR072 | As LR126 "d" but; Natrosol | 0.30 | 1925 |
| RLR074 | As LR126 "d" but; Natrosol | 0.35 | 2500 |

Viscosity measured in a Brookfield LV viscometer at 20° C., spindle 2 speed 6.

TABLE 2

| Viscosity/(centipoise) | Gap between the plates/(mm) | Vertical height/(mm) |
|---|---|---|
| 150 | 1.25 | 2.3 |
| 150 | 1.0 | 3.5 |
| 150 | 0.75 | 6.0 |
| 150 | 0.5 | 8.5 |
| 150 | 0.25 | 16.0 |
| 350 | 1.25 | 2.5 |
| 350 | 1.0 | 5.0 |
| 350 | 0.75 | 6.0 |
| 350 | 0.5 | 9.0 |
| 350 | 0.25 | 16.0 |
| 850 | 1.25 | 2.5 |
| 850 | 1.0 | 3.0 |
| 850 | 0.75 | 6.5 |
| 850 | 0.5 | 8.0 |
| 850 | 0.25 | 16.0 |
| 1925 | 1.25 | 3.0 |
| 1925 | 1.0 | 4.5 |
| 1925 | 0.75 | 6.0 |
| 1925 | 0.5 | 9.0 |
| 1925 | 0.25 | 14.0 |
| 2500 | 1.25 | 2.5 |
| 2500 | 1.0 | 4.0 |
| 2500 | 0.75 | 6.0 |
| 2500 | 0.5 | 8.5 |
| 2500 | 0.25 | 12.0 |
| 3400 | 1.25 | 2.5 |
| 3400 | 1.0 | 4.5 |
| 3400 | 0.75 | 5.5 |
| 3400 | 0.5 | 8.5 |
| 3400 | 0.25 | 11.0 |
| 5100 | 1.25 | 3.2 |
| 5100 | 1.0 | 4.0 |
| 5100 | 0.75 | 5.0 |
| 5100 | 0.5 | 8.5 |
| 5100 | 0.25 | 11.0 |

The collar 64 of insert 60 is spaced slightly above the surface 72 of textile layer 6. The spacing must allow for liquid to escape onto the layer surface. Spacers (not shown) may be provided to ensure that the collar does not sit too tightly on the material surface. If the surface texture has a high profile, then the collar may rest on the surface, but care should be taken not to crush the surface and, in effect, form a seal.

The textile layer 6 may be glued or welded in place, or fixed mechanically by sitting over prongs extending up from the platform 8, or under tines which extend out from a surrounding cage structure. The textile layer 6 may also be self-supporting, for example by fabricating from appropriately stiff fibres, by heat setting, by rigidifying with a glue, etc.

The textile layer 6 may extend into the cup 18 in order to provide the capillary or wicking function for drawing liquid from the cup. Although in this case it is anticipated that lower viscosity liquids are preferred, and the liquid may absorb into the textile layer in order to "wick" sufficient liquid on to the main fabric area 72. Where liquid is absorbed into the textile layer, it may be preferable to support the layer on a mesh like platform to allow flushwater to permeate through the layer.

Figure 6:
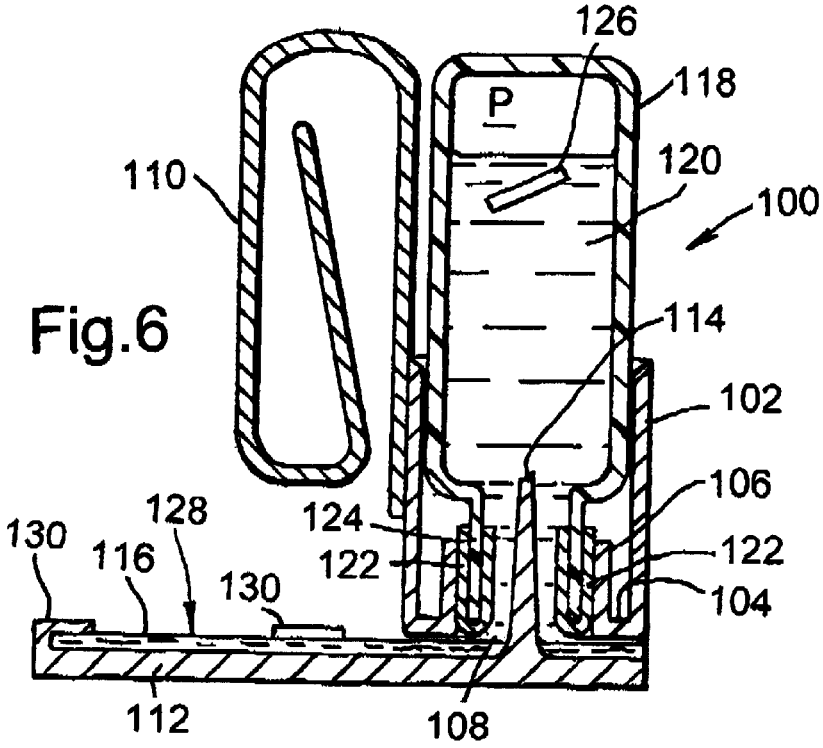
FIG. 6 is a cross-section through a second embodiment of the invention

In FIG. 6 is a cross-section through a second embodiment of the invention. This shows a liquid rim device 100 of the type seen generally in the prior art such as EP-A-0538957, WO99/66139 or WO 00/42261, but in which the liquid delivery surface is formed of textile material.

An outer cage 102 has a base 104 with a cylindrical collar 106 surrounding an aperture 108 in the base.

A flexible strap 110 on the cage 102 is used to hang the device 100 from the rim 20 of a toilet bowl (see FIG. 1).

A flat platform 112 is clipped to the base 104, for example by barbs (not shown) extending through apertures in the base 104.

A prong 114 extends up from the platform 112, through the aperture 108.

A layer 116 of textile material is sandwiched between the platform 112 and the base 104.

A container 118 contains a viscous liquid 120 which is to be dispensed by the device 100. A closure 122 similar to closure 44 of the embodiment of FIGS. 1 to 5, forms a liquid tight seal around a neck 124 of the container 118 and is a snug fit in the collar 106. The container 118 is inverted over the prong 114 and pushed into the cage 102, so that prong 114 displaces a seal 126 from the closure 122. Liquid 120 will then permeate down onto the upper surface 128 of the textile layer 116 in the region of the opening 108 and spread or disperse outwardly across the surface 128 away from the opening 108.

The textile layer 116 is gripped only loosely between the base 104 and platform 112 to allow liquid to permeate outwards over the upper surface 128 of the layer 116. A more porous textile might be used to allow liquid to permeate through the body of the textile layer.

If the liquid 120 is sufficiently viscous, the flow out from the container 118 will be slow, a reduced pressure being created in the space P above the liquid in the container 118.

The textile material 116 may rest loosely on the platform 112 or it may be glued, or held in place mechanically, such as by barbs or clips 130 at edges of the platform.

Various modifications will be apparent to those in the art and it is desired to include all such modifications as fall within the scope of the accompanying claims.

What is claimed is:

1. A liquid delivery device comprising a container for the liquid, a delivery surface, said delivery surface comprising a layer of textile material, and means for releasing the liquid onto the delivery surface, said releasing means including a cup below the level of the textile material, and means for transporting the liquid upwards from the level of liquid in the cup to the upper surface of the textile material.

2. A liquid delivery device as claimed in claim 1, wherein the textile material is knitted.

3. A liquid delivery device as claimed in claim 1, wherein the textile material is woven.

4. A liquid delivery device as claimed in claim 1, wherein the textile material is of polyester.

5. A liquid delivery device as claimed in claim 1, wherein the textile material is hydrophobic.

6. A liquid delivery device as claimed in claim 1, wherein the viscosity of the liquid is greater than 1,500 cP.

7. A liquid delivery device as claimed in claim 1, wherein the viscosity is greater than 3,000 cP.

8. A liquid delivery device as claimed in claim 1, wherein the textile material is supported on a substantially flat platform.

9. A liquid delivery device as claimed in claim 1, wherein the transporting means is a capillary formed between an inner wall of the cup and an insert member inserted in the cup.

10. A liquid delivery device as claimed in claim 1, wherein transporting means is an insert member in the cup, the insert member having a plurality of capillary channels formed in a wall thereof.

11. A device according to claim 10, wherein the upward transport of the liquid product from the cup to the textile layer relies at least in part on capillary action.

12. A device for delivering a liquid product into a receiver in conjunction with a liquid flow into said receiver, the device comprising a textile layer which in use is exposed to said liquid flow, a cup disposed below the layer for receiving liquid product from a container and having a free liquid level open to atmosphere, and means for transporting the liquid product from the cup upwardly and onto the upper surface of the textile layer.

13. A device for delivering a liquid product into a receiver in conjunction with a liquid flow into said receiver, the device comprising a container, a surface of textile material which in use is exposed to said liquid flow, the container having an opening at a lower portion thereof open to atmosphere, and means for transporting the liquid product from the opening to the textile material, said transporting means comprising one or more capillary passages opening onto the textile material.

14. A device as claimed in claim 13, wherein the textile material provides a substantially flat surface area over which the liquid is dispersed.

15. A device for delivering a liquid product into a receiver in conjunction with a liquid flow into said receiver, the device comprising a substrate, which in use is exposed to said liquid flow, a cup disposed below the substrate for receiving liquid product from a container and having a free liquid level open to atmosphere, and means for transporting the liquid product from the cup upwardly to the substrate, wherein the substrate comprises a textile material.

16. A liquid delivery device comprising a container for the liquid, the container having an outlet at a lower end thereof, when the container is positioned for use, whereby the outlet forms a reservoir of liquid at the lower end of the container, with liquid being retained in the container by atmospheric pressure, dispersal means for dispersing the liquid from the outlet, the dispersal means comprising a layer of textile material forming a delivery surface and means for delivering the liquid to the textile material.

17. A liquid dispensing device for suspension from the rim of a toilet bowl, the device comprising:

a bottle for holding a liquid to be dispensed, the bottle having a mouth, a base for holding said bottle, the base having a dispensing plate having an upper surface;

a conduit from the bottle mouth to the dispensing plate, liquid transferring, in use, from the bottle onto the upper surface of the plate via the bottle mouth and the conduit, wherein a layer of textile material is provided on the upper surface of the dispensing plate to disperse the liquid away from the bottle mouth.

18. A liquid dispensing device as claimed in claim 17, wherein the conduit includes one or more capillary channels.

19. A liquid dispensing device as claimed in claim 18, wherein the capillary channel or channels transfer the liquid onto an upper surface of the textile material.

* * * * *